US005237963A

United States Patent [19]

Garcia-Mallol

[11] Patent Number: 5,237,963

[45] Date of Patent: Aug. 24, 1993

[54] SYSTEM AND METHOD FOR TWO-STAGE COMBUSTION IN A FLUIDIZED BED REACTOR

[75] Inventor: Juan A. Garcia-Mallol, Morristown, N.J.

[73] Assignee: Foster Wheeler Energy Corporation, Clinton, N.J.

[21] Appl. No.: 877,916

[22] Filed: May 4, 1992

[51] Int. Cl.[5] ..... F22B 1/00

[52] U.S. Cl. ..... 122/4 D; 110/210; 110/245

[58] Field of Search ..... 110/245, 210-214; 122/4 D

[56] References Cited

U.S. PATENT DOCUMENTS 4,516,510 5/1985 Bousic, Sr. ..... 110/211
4,531,462 7/1985 Payne ..... 110/210
4,594,967 7/1986 Wolowodiuk .
4,617,877 10/1986 Gamble .
4,682,567 7/1987 Garcia-Mallol et al. .
4,694,758 9/1987 Gorzegno et al. .
4,761,131 8/1988 Abdulally .
4,781,574 11/1988 Taylor .
4,896,717 1/1990 Campbell et al. .
4,947,804 8/1990 Abdulally .
4,969,405 11/1990 Goodrich ..... 110/210
5,040,492 8/1991 Dietz .
5,054,436 10/1991 Dietz .
5,069,170 12/1991 Gorzegno et al. .
5,069,171 12/1991 Hansen et al. .
5,141,708 8/1992 Campbell, Jr. et al. ..... 110/245

*Primary Examiner*—Henry C. Yuen
*Attorney, Agent, or Firm*—Marvin A. Naigur

[57] ABSTRACT

A fluidized bed system and method utilizing two stage combustion in which solids in the flue gases from the combustion in the fluidized bed are separated and returned to the bed while the clean flue gases are mixed with gases containing oxygen to effect secondary combustion. The fluidized bed is operated at sub-stochiometric conditions and NOx scavengers are supplied to the flue gases.

13 Claims, 2 Drawing Sheets

SYSTEM AND METHOD FOR TWO-STAGE COMBUSTION IN A FLUIDIZED BED REACTOR

BACKGROUND OF THE INVENTION

This invention relates to a two-stage combustion system and method utilizing a fluidized bed reactor, and, more particularly, to a system and method in which a secondary combustion assembly is provided for secondary combustion of unreacted flue gases containing NOx.

The use of two stage combustion in a fluidized bed system is generally known. For example, Engstrom et al., U.S. Pat. No. 4,616,576, discloses a two stage combustion method in which two circulating fluidized bed systems with their associated cyclone separators are utilized in a series connection to provide an efficient method of combustion with reduced NOx emission. However, the use of a second fluidized bed results in a significant complication of the operational control, substantial systems redundancy and associated increase in system cost. Further, both the fluidized bed and the cyclone separator are subject to wear due to the abrasive action of the circulating particulate matter.

SUMMARY OF THE INVENTION

It is therefore an object of the present invention to provide a system and method of two-stage combustion in a fluidized-bed reactor.

It is a still further object of the present invention to provide a system and method of the above type which enjoys increased combustion efficiency.

It is a still further object of the present invention to provide a system and method of the above type which enjoys reduced NOx emissions.

It is still further object of the present invention to provide a system and method of the above type which provides for the injection and mixing of NOx scavengers.

It is a still further object of the present invention to provide a system and method of the above type which provides the required residence time and temperature for the gases to effect proper NOx scrubbing.

Toward the fulfillment of these and other objects, the system method of the present invention features a fluidized bed operated under reducing conditions in which solids contained in the flue gases discharged from the reactor are separated and recycled into the reactor, and the clean gases are introduced into a second combustion assembly, into which gases containing oxygen are supplied. Also, NOx scavengers are fed into the second combustion assembly to lower NOx emissions.

BRIEF DESCRIPTION OF THE DRAWINGS

The above brief description as well as further objects, features and advantages of the method of the present invention will be more fully appreciated by reference to the following detailed description of presently preferred but nonetheless illustrative embodiments in accordance with the present invention when taken in conjunction with the accompanying drawing in which.

DESCRIPTION OF THE PREFERRED EMBODIMENT

Figure 1:
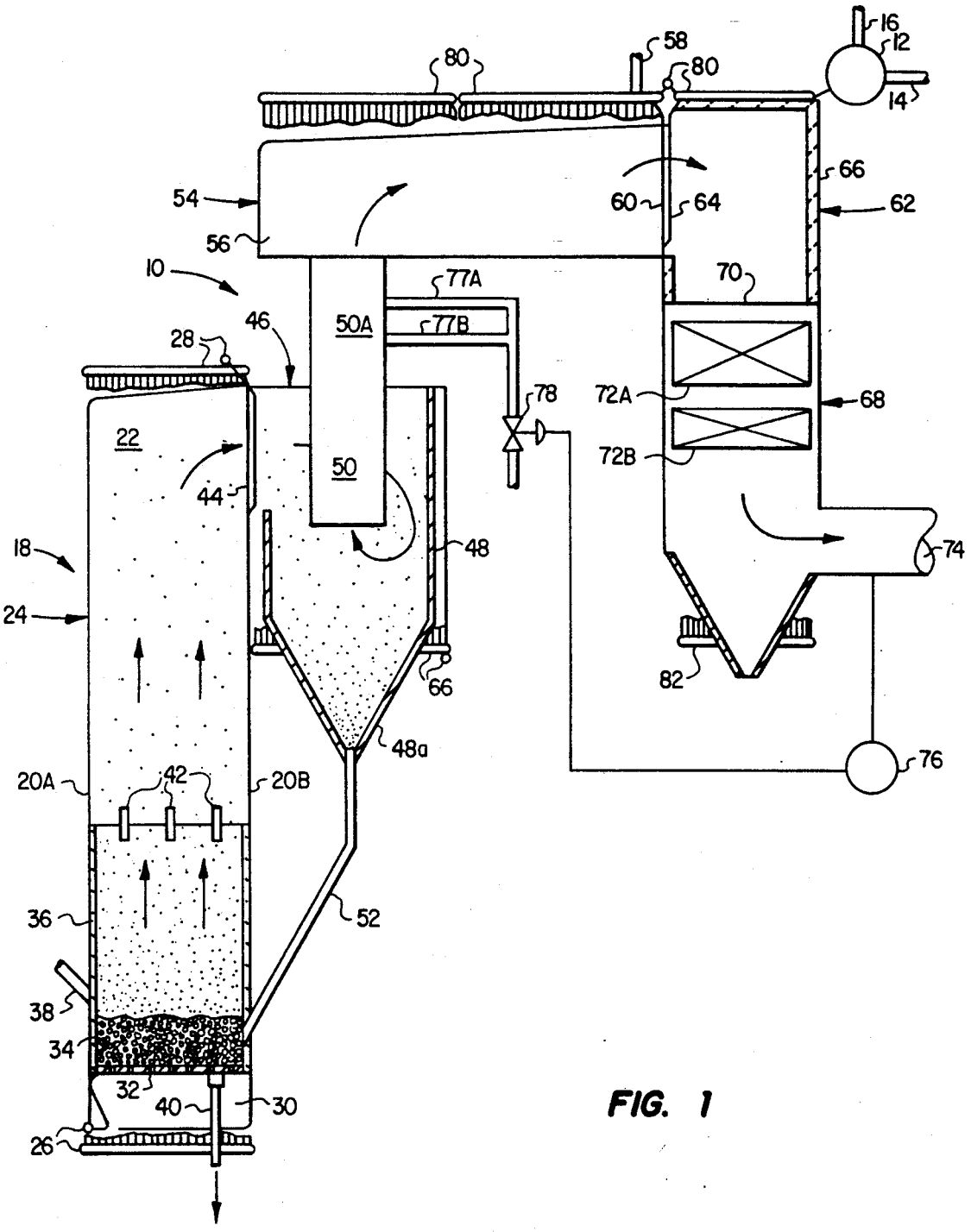
FIG. 1 is a schematic view depicting the fluidized bed reactor of the present invention.

The system and method of the present invention will be described in connection with a fluidized bed reactor forming a portion of natural water circulation steam generator, shown in general by the reference number 10 in FIG. 1 of the drawings.

The steam generator 10 includes a steam drum 12 which receives water from a feed pipe 14 and which discharges the steam generated to external equipment via a plurality of steam pipes 16.

A fluidized bed reactor 18 is disposed adjacent the steam drum 12, and includes a front wall 20A, a spaced, parallel rear wall 20B, and two spaced side walls, one of which is shown by the reference numeral 22, which extend perpendicular to the front and rear walls to form a substantially rectangular furnace 24.

The walls 20A, 20B, and 22 of the reactor 18 are formed by a plurality of vertically-disposed tubes interconnected by vertically-disposed elongated bars, or fins, to form a contiguous, air-tight structure. Since this type of structure is conventional, it is not shown in the drawings nor will it be described in any further detail.

The ends of each of the tubes of the walls 20A, 20B, and 22 are connected to horizontally-disposed lower and upper headers 26 and 28, respectively, for reasons that will be explained later.

A plenum chamber 30 is disposed at the lower portion of the reactor 18 into which pressurized air from a suitable source (not shown) is introduced by conventional means, such as a forced-draft blower, or the like.

A perforated air distribution plate 32 is suitably supported at the lower end of the combustion chamber of the reactor 18, and above the plenum chamber 30. The air introduced through the plenum chamber 30 thus passes in an upwardly direction through the air distribution plate 32 and may be preheated by air preheaters (not shown) and appropriately regulated by air control dampers as needed. The air distribution plate 32 is adapted to support a bed 34 of a particulate material consisting, in general, of crushed coal and limestone, or dolomite, for absorbing the sulfur oxides formed during the combustion of the coal.

The inner surfaces of the lower portion of the walls 20A, 20B, and 22 of the reactor 18 are lined with a refractory 36, or other suitable insulating material, which extends a predetermined distance above the air distribution plate 32.

A fuel distributor 38 extends through the front wall 20A for introducing particulate fuel onto the upper surface of the bed 34, it being understood that other distributors can be associated with the walls 20A, 20B and 22 for distributing particulate sorbent material and/or additional particulate fuel material onto the bed 34, as needed.

A drain pipe 40 registers with an opening in the air distribution plate 32 and extends through the plenum 30 for discharging spent fuel and sorbent material from the bed 34 to external equipment.

A multiplicity of air ports 42 are provided through the sidewall 22 at a predetermined elevation from the bed 34 to introduce secondary air into the boiler for reasons to be described. It is understood that additional air ports at one or more elevations can be provided through the walls 20A, 20B, and the other sidewall as needed.

An opening 44 is formed in the upper portion of the rear wall 20B by bending back some of the tubes (not shown) forming the latter wall to communicate the upper portion of furnace 24 with a separating section 46 disposed adjacent the reactor 18. The separating section 46 includes a cyclone separator 48 having a coaxial tube 50 disposed therein which, together with the walls of the separator, form an annular flow path for the gases entering the separator from the reactor 18. The latter gases swirl around in the annular chamber to separate the entrained solids therefrom by centrifugal forces, before the gases pass to the upper portion of the separating section. The separator 48 includes a hopper portion 48*a* into which the separated solids fall before being passed back into the reactor 18 by a recycle conduit 52, as will be described in further detail. The walls of the separator 48 can also be formed by tubes and fins as discussed above in connection with the reactor walls 20A and 20B and 22, and the lower ends of the tubes forming the separator 48 are connected to a header 53.

A second stage combustion assembly 54 is disposed above the separating section 46 and is in gas flow communication with the separating section. The assembly 54 includes a combustion vessel 56 connected in series with an extension 50A of the tube 50 and provides a reaction chamber for secondary burning of flue gases received from the separating section 50 as will be described. An NOx scavenger injection pipe 58 extends through a wall of the combustion vessel 56 for introducing NOx absorbers into the reaction chamber, it being understood that other pipes can be associated with the vessel 56 for distributing NOx scavengers into the reaction chamber, as needed.

An opening 60 is provided through the distal end of the vessel 56 for connecting the vessel 56 to a NOx scrubbing section 62. A screen 64 is suitably supported in the opening 60 and is adopted to insure proper mixing of the flue gases and NOx scavengers as they pass through the opening. The inner surface of the section 62 is lined with an insulation 66 or other suitable refractory material, as needed, for purposes that will be described later.

A heat recovery enclosure 68 is disposed below the scrubbing section 62 and has an opening 70 formed in an upper wall portion which receives the clean gases from the scrubbing section. A reheater 72 and a superheater 73 are disposed in the heat recovery enclosure 68 in the path of the gases, and each consists of a plurality of tubes connected in a flow circuitry which would include the steam drum 12 and the steam pipes 16 for passing steam through the tubes in a conventional manner to remove heat from the gases. In situation in which the steam generator 10 is connected to a steam turbine the heated steam is passed to the turbine (not shown) for driving the turbine, and the reheater 72 is connected to an outlet of the turbine for receiving spent steam from the turbine, in a conventional manner. An outlet duct 74 is provided for in the enclosure 68 for discharging gases from the enclosure as will be described. An oxygen monitoring device 76 is connected to and disposed below the outlet duct 74 and monitors the excess oxygen in the exit gas from the outlet duct. A pair of air conduits 77A and 77B register with openings in the wall of tube 50A and supply secondary air to the latter tube for passage to the secondary combustion assembly 54. A secondary air control valve 78 is electrically connected to, and receives control signals from, the oxygen monitoring device 76 and operates to control the flow of secondary air to the air conduits 77A and 77B.

The walls forming the upper portions of the heat recovery enclosure 68 are also formed by a plurality of vertically disposed tubes interconnected by vertically disposed elongated bars, or fins to form a contiguous, wall-like structure identical to the reactor walls 20A, 20B and 22. The upper ends of these walls are connected to a plurality of horizontally-extending upper headers 80, and the lower ends of the walls are connected to a plurality of horizontally extending lower headers, one of which is shown by the reference number 82.

Although not shown in the drawing it is understood that water flow circuitry, including downcomers and the like, are provided to connect the steam drum 14 to the headers 26, 28, 53, 80, and 82 and the steam pipes 16 to the reheater 72 and the superheater 73. Thus a flow circuit for the water and steam is formed through the steam drum 12, the reheater 72, the superheater 73, and the walls forming the reactor 18, the separating section 46, and the heat recovery enclosure 68 which circuitry is connected to a steam turbine (not shown). Since this is conventional it will not be described any further.

In the operation of the steam generator 10, a quantity of start-up coal is introduced through the distributor 38 and is spread over the upper surface of the particulate material in the bed 34. Air is introduced into the plenum chamber 30 and the coal within the bed 34 and the start-up coal are ignited by burners (not shown) positioned within the bed and, as the combustion of the coal progresses, additional air is introduced into the plenum chamber 30 at a relatively high pressure and velocity. Alternatively, the bed 34 can be warmed up by a burner located in the plenum 30. The range of air supplied through the plenum 30 can be from 35% to 85% of that required for complete combustion with an additional 60% to 10% is supplied through the ports 42. Thus, in accordance to the operating principles of the present invention, the total amount of oxygen introduced through the plenum 30 and the air ports 42 is controlled so that combustion within the furnace 24 takes place under sub-stoichiometric (reducing) conditions to effect the pyrolysis of combustible material while minimizing the formation of NOx compounds.

The high-pressure, high-velocity, combustion-supporting air introduced by the air distribution plate 32 from the plenum chamber 30 causes the particles of the relatively-fine particulate material, including the fine particles of coal ash and spent limestone, to become entrained within, and to thus be pneumatically transported by, the combustion gases. This mixture of entrained particles and gas rises upwardly within the furnace 24 to form a gas column containing the entrained solids and passes from the reactor 18 through the opening 44 and into the separating section 46.

The quantities of fuel, sorbent and air introduced into the furnace in the foregoing manner are regulated so that the gas column formed in the furnace 24 above the bed 34 is saturated with the solid material, i.e. maximum entrainment of the solid materials by the gas is attained. As a result of the saturation, a portion of the fine solids are retained in the bed 34, which nevertheless exhibits a relatively high percentage volume of solids, such as 20% to 30% of the total volume, when operating at maximum capacity.

The coarse particulate material is accumulated in the lower portion of the furnace 24 along with a portion of the fine material, while the remaining portion of the fine material passes upwardly through the gas column. The relatively fine particles traveling the length of the gas column and exiting from the reactor 18 through the opening 44 are separated from the combustion gases within the separating section 48, and are recycled back to the fluidized bed through the recycle conduit 52. This, plus the introduction of additional particulate fuel and sorbent material through the distributor 38 maintains the saturated gas column above the bed 34.

Water is introduced into the steam drum 12 through the water feed pipe 14 where it mixes with water in the drum 12. Water from the drum 12 is conducted downwardly through downcomers or the like, into the lower headers 26 and the tubes forming the reactor walls 20A, 20B and 22, as described above. Heat from the fluidized bed, the gas column, and the transported solids converts a portion of the water into steam, and the mixture of water and steam rises in the tubes, collects in the upper headers 28, 80, and is transferred to the steam drum 12. The steam and water are separated within the steam drum 12 in a conventional manner, and the separated steam is conducted from the steam drum by the steam pipes 16 to the reheater 72 and the superheater 73 for ultimately passing to a steam turbine, as discussed above. The separated water is mixed with the fresh water supply from the feed pipe 14, and is recirculated through the flow circuitry in the manner just described. Other cooling surfaces, preferably in the form of partition walls with essentially vertical tubes, can be utilized in the furnace 24.

In accordance with a feature of the present invention, the hot clean gases from the separating section 46 pass through the tube extension 50A where secondary air is added through the conduits 77A and 77B so that the combustion vessel 56 is operated at 115–128% stoichiometry as measured by the oxygen monitoring device 76. The addition of secondary air results in secondary combustion of the hot clean gases in the combustion vessel 56 with an associated increase in temperature of the gases. NOx scavengers are introduced in the vessel 56 adjacent the opening 60 to the scrubbing section 62, via the pipe 58, and proper mixing of the flue gases and the NOx scavenger is insured by the screen 64 as the mixture enters the scrubbing section 62. The mixture of clean gases and NOx absorbers pass through the scrubbing section 62 where NOx compounds are destroyed.

The hot clean gases from the scrubbing section 62 pass over the reheater 72 and the superheater to remove additional heat from the gases before the gases exit from the steam generator, via the outlet 74. Thus the temperature of the steam passing through the reheater 72 and the superheater 73 can be controlled by controlling the secondary combustion of the flue gases in the vessel 56. If the air introduced into the plenum 30 is at a relatively high pressure on the order of 10 atmospheres, the gases from the outlet 74 may be directed to a gas turbine, or the like (not shown).

Figure 2:
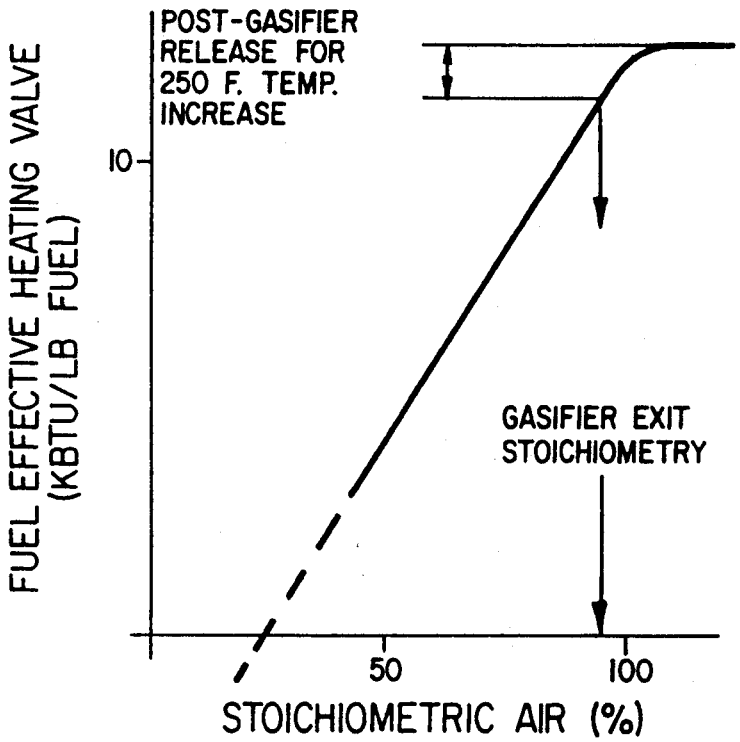
FIG. 2 is a graph depicting an example of the relationship between the stoichiometric air percentage and the effective heating value of the fuel utilizing the system and method of the present invention.

The effective heating value of a bituminous coal as a function of the percentage of stoichiometric air is shown in FIG. 2. The resulting combustion of the hot clean gases in the vessel 56 produces an increase in the temperature of the gases of approximately 250 degree Fahrenheit, as shown in FIG. 2, thus, insuring the destruction of toxic gases, such as carbon monoxide, prior to the gases entering the scrubbing section 62. The temperature of the gases exiting the vessel 56 is limited by the temperature requirements for specific NOx absorbers.

In response to changes in load of the steam turbine, the temperature of the bed 34 is maintained at a preset acceptable value by changing the amount of air supplied to the boiler via the air plenum 30 and the air ports 42.

It is thus seen that the method of the present invention, by incorporating the use of a fluidized bed reactor with a secondary combustion assembly and a NOx scrubbing section has several advantages. For example, the method of the present invention provides for a substantial reduction of NOx emissions due to several factors. First, the furnace is operated under a reducing atmosphere to substantially limit the production of NOx species. Secondly, in conjunction with the preceding advantage, staging of the secondary air in the tube extension 50A with an overfire air fraction reduces the NOx emissions. Also, the secondary combustion of the clean flue gases along with the introduction of the NOx scavengers further reduce the NOx emissions. Further the scrubbing section is provided with insulation which maintains the proper environment for NOx scavengers to considerably reduce any residual NOx. Also, the addition of the combustion assembly 54 increases the temperatures of the flue gases passing to the convection section and thus shifts the duty from the furnace 24 to the convection section which eliminates, in many cases, the need for external heat exchangers located between the hopper portion **48*a* and the furnace 24** thus simplifying design and reducing costs.

Although not specifically illustrated in the drawings, it is understood that other additional necessary equipment and structural components will be provided, and that these and all of the components described above are arranged and supported in any appropriate fashion to form a complete and operative system.

It is also understood that variations may be made in the method of the present invention without departing from the scope of the invention. For example, the second stage combustion assembly may be used with any kind of fluidized bed system.

Of course, other variations in the foregoing can be made by those skilled in the art, and in certain instances some features of the invention will be employed without a corresponding use of other features. Accordingly, it is appropriate that the appended claims be construed broadly and in a manner consistent with the scope of the invention.

What is claimed is:

1. A two stage combustion method comprising the steps of:

establishing a bed of solid particles including fuel;

introducing air to said bed to fluidize said particles to promote the combustion of said fuel particles, whereby the flue gases from said combustion entrain a portion of said particles;

separating said entrained particles from said flue gases;

supplying oxygen-containing gases to said separated flue gases;

then passing said gases from said fluidized bed system into a secondary combustion assembly to combust said flue gases; and supplying an NOx scavenger to said flue gases.

2. The method of claim 1 further comprising the step of recycling said separated solids to said fluidized bed system.

3. The method of claim 1 further comprising the step of operating said fluidized bed under reducing conditions to produce combustible flue gases.

4. The method of claim 1 wherein said step of supplying said NOx scavenger is after said step of passing.

5. The method of claim 4 further comprising the step of removing heat from said combusted flue gases.

6. The method of claim 5 wherein said step of recovery is after said step of supplying said NOx formation-decreasing agent.

7. The method of claim 1 wherein, in said step of introducing, the quantity of air is less than that required for complete combustion and further comprising the step of adding additional air to said bed to complete said combustion.

8. The method of claim 1 further comprising the steps of circulating water in a heat exchange relation to said bed to convert said water to steam and passing said combusted flue gases in a heat exchange relation with said steam to raise the temperature of said steam.

9. A system of two-stage combustion comprising:

means for establishing a bed of solid particles including fuel;

means for introducing air to said bed to fluidize said fuel particles to promote the combustion of said particles, whereby the flue gases from said combustion entrain a portion of said particles;

means for separating said entrained particles from said flue gases;

a secondary combustion assembly connected to said separating means;

means for passing said separated flue gases from said separating means to said secondary combustion assembly to combust said flue gases;

means for supplying oxygen-containing gases to said separated flue gases before said combustion; and means for supplying an NOx scavenger to said flue gases.

10. The system of claim 9 further comprising means for recycling said separated solids to said fluidized bed system.

11. The system of claim 9 further comprising means for removing heat from said combusted flue gases.

12. The system of claim 11 wherein said heat is removed from said combusted flue gases after said NOx scavengers are supplied to said flue gases.

13. The system of claim 1 wherein said bed-establishing means comprises a vessel, and further comprising means for circulating a fluid through the walls of said vessel in a heat exchange relationship with said bed.

* * * * *

UNITED STATES PATENT AND TRADEMARK OFFICE

CERTIFICATE OF CORRECTION

PATENT NO. : 5,237,963

DATED : AUGUST 24, 1993

INVENTOR(S) : JUAN A. GARCIA-MALLOL

It is certified that error appears in the above-identified patent and that said Letters Patent is hereby corrected as shown below: On drawing sheet, FIG. 1, change numeral "72A" to --72--.

FIG. 1, change numeral "72B" to --73--.

FIG. 1, change numeral "66" to --53--.

Column 1, line 37, change "It is still" to --It is a still--.

Column 4, line 16, change "drum 14" to --drum 12--.

Signed and Sealed this

Fifth Day of July, 1994

*Attest:*

*Attesting Officer*

BRUCE LEHMAN

*Commissioner of Patents and Trademarks*